US008769785B2

(12) United States Patent
Krumrey et al.

(10) Patent No.: US 8,769,785 B2
(45) Date of Patent: Jul. 8, 2014

(54) METHOD FOR PRODUCING MULTIPLE FIBRE STRIPS IN PARALLEL AND APPARATUS FOR EXECUTING SAID METHOD

(75) Inventors: Thomas Krumrey, Teningen (DE); Dieter Ruf, Waldkirch (DE); Martin Moser, Elzach (DE)

(73) Assignee: Rhodia Acetow GmbH, Freiburg (DE)

( * ) Notice: Subject to any disclaimer, the term of this patent is extended or adjusted under 35 U.S.C. 154(b) by 392 days.

(21) Appl. No.: 13/202,343

(22) PCT Filed: Feb. 18, 2010

(86) PCT No.: PCT/EP2010/001032

§ 371 (c)(1),
(2), (4) Date: Sep. 26, 2011

(87) PCT Pub. No.: WO2010/094488

PCT Pub. Date: Aug. 26, 2010

(65) Prior Publication Data

US 2012/0013036 A1 Jan. 19, 2012

(30) Foreign Application Priority Data

Feb. 23, 2009 (DE) ..... 10 2009 010 208

(51) Int. Cl.
*D02G 1/12* (2006.01)

(52) U.S. Cl.
USPC ..... 28/263; 28/268; 28/269

(58) Field of Classification Search
USPC ..... 28/263, 268, 269, 262, 282, 247, 116, 28/134, 135, 264, 265, 270; 26/18.6; 19/66.1, 66.2, 66 T, 65 T; 264/168, 282; 425/336
See application file for complete search history.

(56) References Cited

U.S. PATENT DOCUMENTS 3,230,598 A * 1/1966 Rosenstein et al. ..... 28/268

(Continued)

FOREIGN PATENT DOCUMENTS

DE 2504534 8/1976

(Continued)

OTHER PUBLICATIONS

International Search Report for WO2010094488 dated Aug. 26, 2010.

(Continued)

*Primary Examiner* — Amy Vanatta
(74) *Attorney, Agent, or Firm* — Morgan Lewis & Bockius LLP

(57) ABSTRACT

The invention relates to methods for simultaneously producing crimped fiber strips in parallel, in particular filter tow strips, in a crimping machine (KM) having an inlet region (3), a squeezing zone (6) formed between two transport rollers (4, 5), and a compression channel (7), comprising the following steps: a) simultaneously feeding in parallel a plurality of fiber strips (1, 2) via the inlet region (3), wherein the fiber strips are guided separately in the inlet region (3), using a first separating device (31), b) simultaneously transporting and compacting in parallel the fiber strips in the squeezing zone (6) by way of the two transport rollers (4, 5), and c) simultaneously crimping in parallel the fiber strips in the compression channel (7), wherein the fiber strips are guided separately in method step b) by using a second separating device (61) and in method step c) by using a third separating device (71), and wherein the first, second and third separating devices (31, 61, 71) are designed such that the separate guidance in parallel of the fiber strips takes place from the inlet region (3) through the squeezing zone (6) into the compression channel (7) without interruption. Moreover, the invention relates to an apparatus for executing said method. The invention enables the simultaneous formation of a plurality of separate, crimped fiber strips, having a substantially constant and symmetric crimping characteristic over the respective entire fiber strip cross-section, and in particular also cost-effective production of crimped filter tow strips, having a low overall titer, by avoiding the phenomenon of the split-off edge, by way of a conventional spinning and crimping machine.

18 Claims, 1 Drawing Sheet

(56) References Cited

U.S. PATENT DOCUMENTS

| | | | | | |
|---|---|---|---|---|---|
| 3,351,993 | A | * | 11/1967 | Rosenstein et al. | 28/266 |
| 3,406,436 | A | * | 10/1968 | Clarke, Jr. | 28/250 |
| 3,505,155 | A | * | 4/1970 | Balch et al. | 428/86 |
| 3,553,802 | A | * | 1/1971 | Stanley | 28/268 |
| 3,762,281 | A | | 10/1973 | Burrus et al. | |
| 5,020,198 | A | * | 6/1991 | Hill et al. | 28/250 |
| 5,319,831 | A | * | 6/1994 | Takehara | 28/263 |
| 5,776,404 | A | * | 7/1998 | Dollhopf | 264/282 |
| 5,860,201 | A | * | 1/1999 | Dollhopf | 28/263 |
| 5,974,777 | A | * | 11/1999 | Davis | 57/290 |
| 6,302,308 | B1 | * | 10/2001 | Hoover et al. | 226/90 |
| 7,228,604 | B2 | * | 6/2007 | Hoover | 28/220 |

FOREIGN PATENT DOCUMENTS

| | | | |
|---|---|---|---|
| DE | 2504534 | A1 | 8/1976 |
| DE | 102007022112 | | 11/2007 |
| DE | 102007022112 | A1 | 11/2007 |
| EP | 0357257 | A1 | 3/1990 |
| EP | 0629722 | | 3/1994 |
| EP | 0629722 | A1 | 12/1994 |
| JP | 44-006151 | B | 3/1944 |
| JP | 53-024422 | A | 3/1978 |
| JP | 56-004724 | A | 1/1981 |
| JP | 07-048771 | A | 2/1995 |
| RU | 2095499 | C1 | 11/1997 |
| SU | 183670 | A1 | 7/1966 |
| SU | 521829 | A3 | 7/1976 |
| UA | 72595 | C2 | 3/2005 |

OTHER PUBLICATIONS

Notification of the First Office Action for Chinese Patent Application No. 20108000654.7 dated Mar. 25, 2013.

Decision to Grant for Russian Patent Application No. 2011138936 dated Jul. 1, 2013.

Notification of Reasons for Refusal dated Jan. 10, 2014 for Japanese Patent Application No. 2011-550477.

* cited by examiner

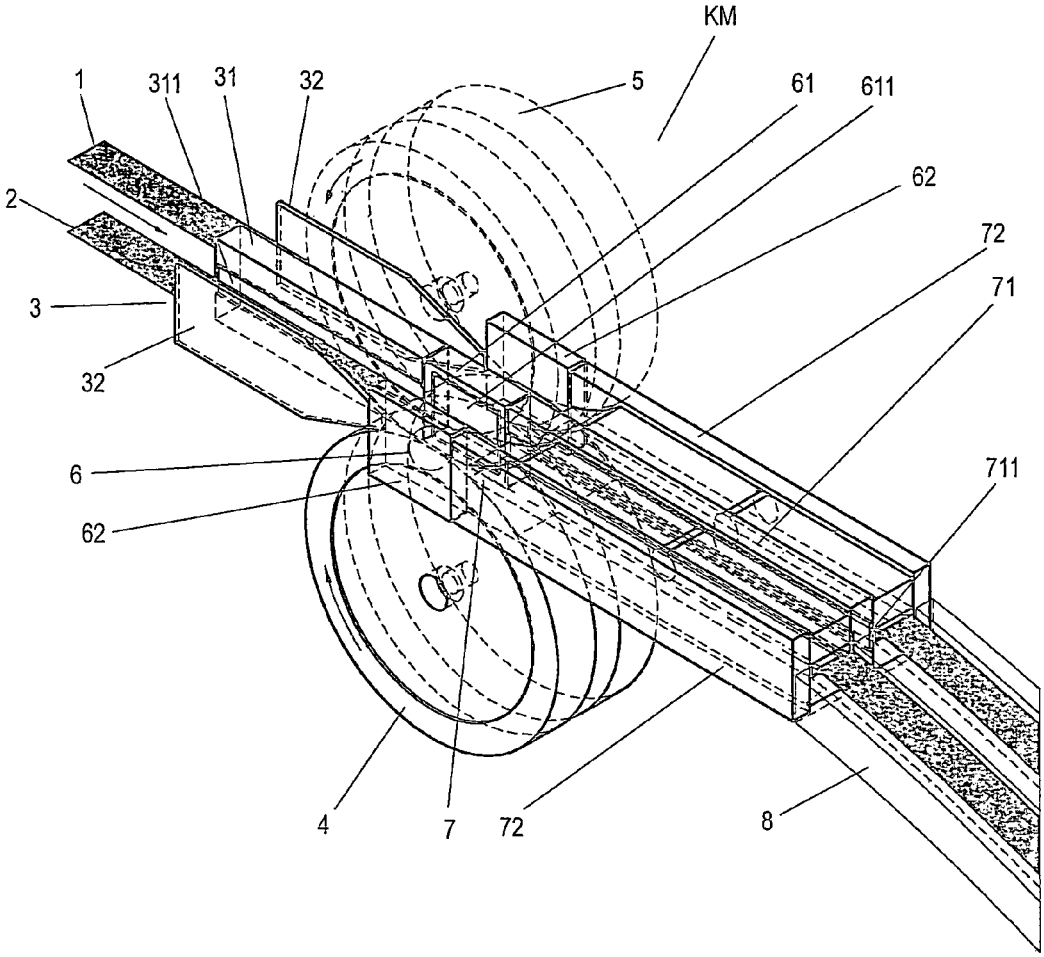
KM
1
311
31
32
5
61
611
2
62
72
3
71
32
6
711
62
4
7
72
8

METHOD FOR PRODUCING MULTIPLE FIBRE STRIPS IN PARALLEL AND APPARATUS FOR EXECUTING SAID METHOD

This application is a National Stage Patent Application of International Application No. PCT/EP2010/001032, filed Feb. 18, 2010, which claims priority to German Patent Application No. 10 2009 010 208.6 filed on Feb. 23, 2009 which are each incorporated herein by reference in their entirety.

The invention relates to a method for the parallel production of a plurality of fibre strips, especially a plurality of filter tow strips, according to the preamble of claim 1 and an apparatus for executing said method according to the preamble of claim 11.

The document EP 0 629 722 A1 describes a filter tow strip of this type made of cross-linked filaments or fibres, as used manufactured, for example from cellulose acetate, in the production of cigarette filters.

A filter tow made of cellulose acetate typically comprise of more than 1,000 filaments, which are formed by fine spray nozzles from acetate flakes substantially dissolved in acetone and are firstly present as uncrimped fibre strips, each with filaments oriented in the longitudinal direction. These fibre strips only receive their mechanical stability required for use in cigarette filters and the necessary tensile strength by a crimping treatment, in which the linearly arranged filaments are formed in a zigzag shape in a so-called compression channel into crimped fibre strips with substantially constant and symmetrical crimping characteristics over the entire fibre strip cross-section; typical parameters for describing the crimping characteristics are the crimping index (number of crimpings per length of filter tow) and the degree of cross-linking (number of links between crimped adjacent filaments per length of filter tow). The crimped filter tow strips or filter strands thus obtained have a constant total titre (weight per meter of uncrimped filter tow length) and exhibit a uniform cross-linking or linking between the filaments over the entire strip width. They are generally deposited in a depositing container, pressed and packed as bales for preparation for further use.

Proceeding from this, EP 0 629 722 A1 teaches efficient production of a filter tow strip made of crimped, cross-linked filaments of the aforementioned type, which is made possible in that a plurality of filter tow strips is produced in parallel in the same apparatus, the filter tow strips produced in parallel in each case being connected by desired tear lines which run in the longitudinal direction of the strip and have a smaller degree of cross-linking compared to the respective filter body, so a so-called multi-width fibre strip is firstly produced. A multi-width fibre strip of this type is distinguished by its further processability in conventional preparation apparatuses, especially in double filter rod machines with a single preparation part and leads to a substantial reduction in the setting up costs there in that a plurality of filter tow strips is in each case provided simultaneously and in a defined manner per work operation by a filter tow bale and the separation can be carried out without problems and reliably by means of the severing of the desired tear lines.

Although the individual filter tow strips obtained according to EP 0 629 722 A1 from a multi-width filter tow strip by severing along the desired tear lines also have substantially the same total titre and crimp index, it has been shown that after severing along the desired tear lines problems occur to an increased extent with split-off edges, as a result of the low number of crimp bends per filter tow length in the separation region and therefore the low degree of cross-linking of the filaments.

Split-off or even unstable edges may, however, impair the quality of the end product, for example a cigarette filter and all the more so, the lower the total titre of the processed crimped filter tow strip. An increased production of so-called edge dust, which above all in modern fast-running filter rod machines leads to fluctuating qualities in the filter rods produced, is linked with the phenomenon of the split-off edge.

The invention is based on the aim of disclosing a method for the simultaneous, parallel production of a plurality of crimped fibre strips, especially a plurality of filter tow strips, which is suitable for overcoming the aforementioned drawbacks of the prior art, in other words avoiding, even with a small total titre of the fibre strips, especially, losses in productivity and the phenomenon of the split-off edge with its after effects or, expressed differently, to make possible the production of crimped fibre strips with an edge quality known from conventionally produced standard tow, and specifically while maintaining the productivity advantages described in EP 0 629 722 A1 especially in the case of small total titres, as demanded, for example, by the market for slim and super slim filters. Moreover, an apparatus for carrying out this method is to be proposed.

This aim of the invention is achieved by a method for the simultaneous, parallel production of crimped fibre strips, especially filter tow strips in a crimping machine with an inlet region, a squeezing zone formed between two transport rollers and a compression channel, with the successive method steps according to claim 1: a) simultaneously feeding a plurality of fibre strips in parallel via the inlet region, the fibre strips being guided separately in the inlet region using a first separating mechanism, b) simultaneous, parallel transportation and compression of the fibre strips in the squeezing zone by means of the two transport rollers and c) simultaneous, parallel crimping of the fibre strips in the compression channel, wherein the method is characterised in that the fibre strips in method step b) using a second separating mechanism, and in method step c) using a third separating mechanism, are in each case guided separately, the first, second and third separating mechanism being configured such that the parallel separate guidance of the fibre strips from the inlet region through the squeezing zone into the compression channel takes place free of interruption.

The achievement component of the aim of the invention is also an apparatus for the simultaneous, parallel production of crimped fibre strips, especially filter tow strips, according to claim 11, having an inlet region with a first separating mechanism for the simultaneous, parallel and separate feeding of a plurality of fibre strips, a transport roller pair for the simultaneous, parallel transporting and compression of the fibre strips in a squeezing zone and a compression channel for the simultaneous, parallel crimping of the fibre strips, the apparatus being characterised in that a second separating mechanism for separate transporting and compression is provided in the squeezing zone and a third separating mechanism for separate crimping of the fibre strips is provided in the compression channel, the first, second and third separating mechanism being configured in such a way that the fibre strips can be guided separately free of interruption and in parallel from the inlet region through the squeezing zone into the compression channel.

The invention allows the simultaneous configuration of a plurality of crimped fibre strips separated from one another with substantially constant and symmetrical crimping characteristics over the entire respective fibre strip cross-section.

The method according to the invention and the apparatus disclosed to carry it out means that crimped fibre strips, especially filter tow strips, even with a small total titre, can be produced just as economically as the multi-width fibre strips according to the disclosed prior art. As in the production of these multi-width fibre strips, for this purpose, the linear filaments produced by a conventional spinning machine are firstly allocated in a simple manner to a large number of fibre bands in order to then be fed by a first separating mechanism for simultaneous and parallel production of a corresponding number of independently crimped fibre strips to the crimping machine.

However, while the multi-width crimped fibre strips, depending on the configuration of the first separating mechanism in the inlet region of the crimping machine, in each case along the desired tear line between two adjacent fibre strips, form a more or less wide region with relatively undefined crimping characteristics, which is exhibited in the separated fibre strips as a correspondingly unstable edge with clearly coarser crimping—i.e. with a smaller number of crimping bends per stretched filter tow length—the crimped fibre strips produced in parallel according to the invention are comparatively reinforced in the edge region and are distinguished by substantially constant and symmetrical crimping characteristics over the respective entire fibre strip cross-section, so the phenomenon of the split-off edge does not occur with the after-effects linked therewith.

Thus, the invention does not only allow productivity or efficiency comparable with the production method for multi-width fibre strips in the production of crimped fibre strips with a small total titre, but is also distinguished by a high product quality comparable with conventionally produced standard filter tow, namely a lateral edge shape with symmetrical crimping such as corresponds with current conventional commercial standard filter tow. This high product quality is expressed especially advantageously by a substantially reduced edge dust formation compared to separated multi-width fibre strips during the further processing of the fibre strips produced according to the invention.

The desired high product quality of the fibre strips produced and the simultaneous productivity increase in the production thereof with an available spinning and crimping machine cannot be achieved, especially, if a separation of the fibre strips only takes place from the inlet region to the squeezing zone and in the outlet region, in other words following the compression channel, or additionally in the compression channel. As extensive corresponding tests have shown, only crimped fibre strips with an inadequate edge quality can be obtained, in this case, in this manner. However, these advantages are surprisingly produced with a completely separate guidance of the adjacent fibre strips beyond the squeezing zone into the compression channel, as comprised by the subjects of the invention. A further productivity advantage can finally be achieved with the invention inasmuch as, accordingly, higher spinning speeds are made possible compared to the method described in EP 0 629 722 A1.

Advantageous developments of the method according to the invention are disclosed in the dependent claims 2 to 10. These developments will be described in more detail below stating the respective advantages and including the corresponding advantageous embodiments of the apparatus according to the invention according to the dependent claims 12 to 18.

Uncrimped fibre strands or strips, each with filaments oriented substantially along the strip longitudinal direction, are used for the production of the crimped fibre strips or filter tow, with no restrictions of any kind existing with regard to the filament material. With regard to a further processing into cigarette filters, or more generally, into filter rods for smokeable products, it is, however, preferred to use filaments made of cellulose acetate, polyethylene terephthalate, polyolefins (such as polypropylene), polyhydroxybuteric acid esters, polyamides (for example nylon) and viscose.

In addition to the simultaneous, parallel guidance, already known from the disclosed prior art, of a plurality of uncrimped fibre strips into the crimping machine, in which a separate guidance of the fibre strips within the inlet region of the crimping machine is ensured by means of a separating mechanism with at least a first separating means in the form of a separating plate between two respective adjacent fibre strips, the invention provides a second separating mechanism with at least a second separating means directly following this first separating mechanism, which extends over the entire direct feed, contact and exit region of the motor-driven transport roller pair used in a known manner as a joint fibre strip transport means and which provides a second separating means between two respective fibre strips in order to guide the latter in parallel with complete separation, in other words free of interruption. The fibre strip transport in the direction of a compression channel, which is provided for parallel crimping of all the fed fibre strips, takes place by means of friction between the respective fibre strip upper side and the upper transport roller and the fibre strip lower side and the lower transport roller.

According to the invention at least two crimped fibre strips are preferably simultaneously produced along a linear transport path in a crimping machine. Especially preferred is also the simultaneous, parallel production of three, four or five crimped fibre strips in a crimping machine. The first and second separating mechanism provided in this case therefore differ substantially only in the number of respectively required first and second separating means. The number of these depends on the number of fibre strips to be guided separately simultaneously, in parallel and directly next to one another, in each case, through the crimping machine, between which a mechanical component of this type is to be provided in each case. Therefore, per separating mechanism, n−1 separating means are provided in a parallel arrangement, n standing for the number of fibre strips to be guided in parallel in the crimping machine.

The region between the transporting rollers, in other words, the direct feed, contact and exit region of the transport roller pair is designated a squeezing zone here. The clearance between the two transport rollers rotating in parallel with respect to one another can be adjusted and is preferably adjusted in such a way that the transport of each fibre strip takes place with the simultaneous compression thereof by means of the transport roller pair. In other words: the second separating mechanism has the purpose of reliably separating each of the fibre strips fed in parallel during passage through the squeezing zone between the transport roller pair acting as a joint transport and compression means from the respective adjacent fibre strip(s).

It is preferred here for a separating sword to be provided as the first separating means between two respective adjacently guided fibre strips in the first separating mechanism in the inlet region of the crimping machine. In order to ensure separate guidance, free of interruption, of these fibre strips into the squeezing zone between the transport rollers, the second separating mechanism preferably comprises, as the second separating means, a separating sword extension between two respective adjacently guided fibre strips, which is connected, in as gap-free a manner as possible, to the corresponding separating sword; a maximum spacing between two components of less than about half a filament diameter is called gap-free in the scope of this invention and is suitable in this respect to prevent a squeezing in of an individual filament. It is advantageous here if the separating sword extension completely penetrates the squeezing zone and a continuously separated guidance of the fibre strips fed in parallel to the crimping machine is made possible in the inlet region and in the squeezing zone.

According to this advantageous configuration of the invention, on the one hand, the first separating means is configured as a separating sword and the second separating means is configured as a separating sword extension for the complete separation of, in each case, two of the fibre strips guided in parallel and allocated to one another in such a way that a squeezing in of a single filament of the fibre strips guided in parallel into the gap between the separating sword of separating sword extension is prevented, the allocation in this respect thus being gap-free. On the other hand, the separating sword extension and the two transport rollers in the region of the squeezing zone are allocated to one another in such a way that a complete and gap-free penetration of the squeezing zone by the second separating means is provided, so guidance, free of interruption, of the two respective parallel fibre strips along the first and second separating means is ensured. In other words, the first separating means is preferably configured as a separating sword and the second separating means is preferably configured as a separating sword extension, one separating sword and one separating sword extension being arranged in a gap-free connection between two respective fibre strips in such a way that the separating sword extension penetrates the two transport rollers in the region of the squeezing zone, completely and in a gap-free manner. It is accordingly advantageous that the method according to the invention is carried out with this apparatus, namely using a separating sword and a separating sword extension in a gap-free arrangement and with a complete and gap-free penetration of the two transport rollers in the region of the squeezing zone by the second separating means or the separating sword extension, for complete separation of two of the respective fibre strips guided in parallel.

In an advantageous manner, the complete penetration of the squeezing zone by the separating sword extension is ensured by means of opposing grooves in the lateral surface of the transport roller pair, the separating sword extension penetrating the two transport rollers in the region of the squeezing zones, contactlessly in grooves, for the complete separation of the two respective fibre strips guided in parallel. The respective groove depth is to be dimensioned in accordance with the dimensions of the second separating means and its relative position in the transport plane within the squeezing zone, the height of the second separating means between the fibre strips in each case being greater than the clearance in the squeezing zone between the two transport rollers. The second separating means and the two transport rollers are, in this case, preferably allocated to one another in such a way that a squeezing in of a single filament of the fibre strips guided in parallel into the respective groove is prevented, the allocation to this extent thus being gap-free and a complete separation of two respective fibre strips guided in parallel being made possible in the squeezing zone formed between the two transport rollers. The groove width depends on the width of the respectively used second separating means in the squeezing zone. Possible materials for a separating mechanism are therefore all the materials of adequate strength generally used in engineering. A complete separation of the fibre strips running through the squeezing zone in parallel is reliably brought about by this preferred configuration of the second separating mechanism.

The requirement for separation that is as complete as possible of the adjacent fibre strips in the squeezing zone of the crimping machine is, of course, not only to be met in the preferred manner with the separating sword extension and grooved transport rollers as a second separating mechanism. Rather, the person skilled in the art will carry out the structural design of the second separating mechanism and every second separating means comprised thereby in an expedient manner taking into account the filament materials to be processed, which is why all the embodiments of this type, which ensure a simultaneous separate guidance of a plurality of fibre strips are comprised by the invention and likewise preferred. As an alternative to the type of embodiment disclosed as preferred, for example in the individual case, separating plates or separating sword extensions with semicircular recesses may thus be advantageous, the recesses being dimensioned in each case such that they surround the two transport rollers in the squeezing zone, as far as possible in a gap-free manner, or contactlessly penetrate, for example only in channels with a low depth, in the manner of a tongue-and-groove connection.

The third separating mechanism is provided directly after the second separating mechanism and is designed in the connection region in such a way that guidance, free of interruption, of the adjacent fibre strips from the squeezing zone into the compression channel of the crimping machine is ensured. Like the first and second separating mechanism, the third separating mechanism also comprises at least a third separating means between two of the respective fibre strips to be guided, in order to allow the completely separate guidance thereof.

In the compression channel, the crimping of the fibre strips fed in parallel by means of the transport roller pair takes place in a known manner in accordance with the compression chamber principle, the separate guidance of the individual fibre strips in the transport plane during the crimping process being ensured by a compression channel base, a movable compression channel cover and either one of the two compression channel side walls and a third separating means or two of the third separating means in the transport direction.

According to the invention, the third separating mechanism in the compression channel is configured in such a way that it in any case divides the inlet region thereof into parallel regions for the separate guidance of the fibre strips on entry into the compression channel.

It may, however, also be advantageous to configure the third separating mechanism in such a way that it allows a completely separate guidance of the individual fibre strips during the parallel crimping treatment, in other words from entry to leaving the compression channel. It is preferred in this case for the third separating mechanism to be provided with at least a third separating means in the form of a separating web between two respective adjacent fibre strips, the or each separating web extending vertically between the compression channel base and the movable compression channel cover and dividing the entire compression channel in the longitudinal direction. The separation of the entry region of the compression channel that is adequate in individual cases is preferably likewise effected by means of separating webs.

In an advantageous manner, the first separating means in the inlet region of the crimping machine, the second separating means in the region between the transport rollers and the third separating means in the compression channel between two of the fibre strips guided in parallel in each case are provided as a respective separate component—and in this respect multi-part—in an arrangement which is as far as possible gap-free. However, it is also preferred for the first, second and third separating means to be configured as a single component—therefore single-part—, so that it extends free of interruption from the inlet region via the squeezing zone into the compression channel of the crimping machine.

Depending on the structural design of the crimping machine, a multi-part configuration of the first, second and third separating means may, moreover, also be preferred such that the first and second separating means are configured to be one-part and in an arrangement, which is gap-free as far as possible, with respect to a separate third separating means. Furthermore, it may likewise be preferred for the first separating means to be provided separately and the second and third separating means to be provided in one-part and in an arrangement, which is as gap-free as possible, with respect to the first separating means. Finally, it may also be advantageous to provide the first separating means in the inlet region of the crimping machine, the second separating means in the region between the transport rollers and/or the third separating means in the compression channel, in each case to be multi-part, and in this respect in the form of separating means segments, which are in turn allocated to one another in as gap-free a manner as possible.

The hinged movement required for the crimping process of the upper compression channel cover is ensured by a corresponding structural design of the compression channel and the third separating mechanism comprised thereby.

The lateral guide means also always provided for the outer or lateral limitation of the fibre strip transport path and the fibre strip transport plane within the crimping machine are configured in a known manner, for example as guide plates in the inlet region, as discs placed on the transport roller ends with a diameter which is increased compared to the respective roller diameter in the squeezing region, or as chutes configured in a channel-like manner for each individual crimped fibre strip in the outlet region of the crimping machine. These lateral limitations of the fibre strip transport path are designated first lateral guide elements in the inlet region, second lateral guide elements in the region of the squeezing zone and third lateral guide elements in the region of the compression channel.

A production of the crimped fibre strips with the same or a different width is also preferred. This is brought about by a corresponding spacing of the first, second and third separating means within the fibre strip transport path limited by the outer guide means. An individual control of the crimped fibre strip width is made possible by a corresponding adjustment of the spacings between the individual separating means, optionally with the installation of further separating means or the removal of existing ones, within the fibre strip transport path in a known manner.

With regard to an economical provision of the crimped fibre strips produced in parallel, it is preferred that these be firstly deposited separately in a joint depositing container after leaving the crimping machine and that they are then packed in the desired quantity to form joint bales. It may also be advantageous to deposit these fibre strips separately, to press them, and pack them into separate bales, in each case.

A preferred configuration of the apparatus according to the invention is represented in the accompanying FIG. 1.

FIG. 1 shows a crimping machine for the simultaneous, parallel production of two crimped fibre strips with a first, second and third separating mechanism and the fibre strips guided therein, in a perspective view.

The preferred embodiment shown in FIG. 1 of the apparatus according to the invention is configured for the parallel production of two crimped fibre or filter tow strips from two uncrimped fibre or filter tow strips (1, 2), which have the same width and are separated from one another, with cellulose acetate filaments oriented substantially in the transport direction. In accordance with the crimping function to be carried out therewith, the apparatus according to the invention is also called a crimping machine (KM).

The crimping machine shown (KM) comprises, for the simultaneous, parallel feeding of two uncrimped fibre strips (1, 2), an inlet region (3). The latter is laterally limited in a known manner by two first guide elements (32) laterally arranged in the transport direction (see arrow) of the two fibre strips (1, 2), said guide elements being in the form of guide plates. A first separating mechanism (31) with a first separating means (311) is configured in the form of a separating sword between the lateral limitations, said separating sword allowing a guidance, free of interruption, of the also shown uncrimped fibred strips (1, 2) in the inlet region (3) in a substantially horizontal transport plane.

Arranged between the inlet region (3) and the compression channel (7) is a motor-driven transport roller pair (4, 5), which cooperates in a known manner with the compression channel (7), in order to produce the desired crimped fibre strips from the fed uncrimped fibre strips (1, 2) according to the compression chamber principle.

Owing to the structural allocation of the inlet region (3) and the transport roller pair (4, 5), on the one hand, and the transport roller pair (4, 5) and the compression channel (7), on the other hand, it is ensured that the transport plane extends horizontally via the squeezing zone (6) between the two transport rollers (4, 5) into the compression channel (7).

Adjoining the first separating mechanism (31), in a gap-free manner, is a second separating mechanism (61) in the region between the two transport rollers (4, 5); the second transport roller (5) is shown by dashed lines for reasons of clarity. This second separating mechanism (61) comprises a second separating means (611) in the form of an extension of the separating sword provided as the first separating means (311). For the purposes of a completely separate guidance of the two uncrimped fibre strips (1, 2) in the transport roller region across the squeezing zone (6), each of the two transport rollers (4, 5) has a groove with a depth of about half the width of the separating sword extension, so a complete, gap-free and contactless penetration of the separating sword extension and transport roller pair (4, 5) is ensured and whereby, in this respect, a transportation, completely separated from one another, and compression of the two uncrimped fibre strips (1, 2) by the transport roller pair (4, 5) is made possible.

A second lateral guide element (62) is provided in a gap-free arrangement with the respective corresponding first lateral guide element (32) in the inlet region (3) for the lateral guidance of the two uncrimped fibre strips (1, 2) in the transport roller region.

The third separating apparatus (71) in the compression channel (7) in turn adjoins, in a gap-free manner, the separating sword extension provided as the second separating means (611). Said third separating apparatus has a separating web as the third separating means (711), which extends over the entire length and height of the compression chamber (7) and which, with the compression channel base, in each case a compression channel side wall—as the third lateral guide element (72) for lateral limitation of the transport plane—and the movable compression channel cover, defines two separate compression channels arranged in parallel for the spatially separate crimping of the two fibre strips guided in parallel.

The respective third lateral guide element (72) adjoins the corresponding second lateral guide element (62) in a gap-free manner.

For the separate depositing of the two crimped fibre strips, the compression channel (7), which is divided into two, opens into an outlet region (8) with two chutes in order to, in each case, deposit one of the two crimped fibre strips.

LIST OF REFERENCE NUMERALS

KM crimping machine
1, 2 fibre strip/filter tow strip
3 inlet region
31 first separating mechanism
311 first separating means
32 first lateral guide element
4, 5 transport roller
6 squeezing zone
61 second separating apparatus
611 second separating means
62 second lateral guide element
7 compression channel/compression chamber
71 third separating mechanism
711 third separating means
72 third lateral guide element
8 outlet region/chute

The invention claimed is:

1. A method for the simultaneous, parallel production of crimped fibre strips in a crimping machine with an inlet region, a squeezing zone formed between two transport rollers and a compression channel, having the method steps:

a) simultaneously feeding a plurality of fibre strips in parallel via the inlet region, the fibre strips being guided separately in the inlet region using a first separating mechanism, b) simultaneous, parallel transportation and compression of the fibre strips in the squeezing zone by means of the two transport rollers and c) simultaneous, parallel crimping of the fibre strips in the compression channel, wherein the fibre strips in method step b) using a second separating mechanism and, in method step c) using a third separating mechanism, are in each case guided separately, the first, second and third separating mechanism being configured such that the parallel separate guidance of the fibre strips from the inlet region through the squeezing zone into the compression channel takes place free of interruption.

2. A method according to claim 1, wherein the method step a) is carried out using the first separating mechanism having at least one first separating means and method step b) is carried out using the second separating mechanism having at least one second separating means, wherein the at least one first and second separating means are arranged between two of the fibre strips, in each case, in such a way that they are guided in parallel with complete separation.

3. A method according to claim 2, wherein the method step a) is carried out using a separating sword as the at least one first separating means and method step b) is carried out using a separating sword extension as the at least one second separating means, the complete separation of two of the fibre strips guided in parallel, in each case, being brought about by the separating sword and the separating sword extension in a gap-free arrangement and the separating sword extension penetrating the two transport rollers in the region of the squeezing zone, completely and in a gap-free manner.

4. A method according to claim 3, wherein the method step b) is carried out using the separating sword extension between two of the fibre strips, in each case, which penetrates the two transport rollers without contacting the two transport rollers in the region of the squeezing zone in grooves.

5. A method according to claim 1, wherein in method step c), the fibre strips are guided using the third separating mechanism, from entering to leaving the compression channel, with complete separation.

6. A method according to claim 1, wherein the method step c) is carried out using the third separating mechanism having at least a third separating means, the third separating means being arranged between two of the fibre strips in each case in such a way that the latter are guided in parallel with complete separation.

7. A method according to claim 6, wherein the method step c) is carried out using a separating web as the third separating means, the complete separation of two of the fibre strips guided in parallel, in each case, being brought about by the separating web.

8. A method according to claim 2, wherein the third separating mechanism has at least one third separating means and wherein in the method steps a) to c), the at lease one first, second and third separating means are arranged between two of the fibre strips guided in parallel, in each case, in such a way that the fibre strips are guided, in parallel and completely separately, with the same or a different width, from the inlet region through the squeezing zone into the compression channel.

9. A method according to claim 8, wherein the first, second and third separating means between two of the fibre strips guided in parallel, in each case, are used as a one-part or as a multi-part separating means with a first, second and third separating region.

10. A method according to claim 1, wherein the fibre strips crimped after method step c) are deposited in a joint depositing container after leaving the compression channel.

11. An apparatus for the simultaneous, parallel production of crimped fibre strips comprising:

an inlet region with a first separating mechanism for the simultaneous, parallel and separate feeding of a plurality of fibre strips;

a transport roller pair for the simultaneous, parallel transporting and compression of the fibre strips in a squeezing zone;

a compression channel for the simultaneous, parallel crimping of the fibre strips, a second separating mechanism for separate transporting and compression in the squeezing zone; and a third separating mechanism for separate crimping of the fibre strips in the compression channel, the first, second and third separating mechanism being configured in such a way that the fibre strips can be guided separately free of interruption in parallel from the inlet region through the squeezing zone into the compression channel.

12. An apparatus according to claim 11, wherein the first separating mechanism comprises at least one first separating means and the second separating mechanism comprises at least one second separating means, the at least one first and second separating means being arranged between two of the fibre strips, in each case, in such a way that these can be guided separately free of interruption.

13. An apparatus according to claim 12, wherein the at least one first separating means is configured as a separating sword and the at least one second separating means is configured as a separating sword extension, the separating sword and the separating sword extension being arranged in a gap-free connection between two of the fibre strips, in each case, in such a way, that the separating sword extension penetrates the two transport rollers, completely and in a gap-free manner, in the region of the squeezing zone.

14. An apparatus according to claim 13, wherein the separating sword extension contactlessly penetrates the two transport rollers in the region of the squeezing zone in grooves, between two of the fibre strips guided in parallel, in each case.

15. An apparatus according to claim 11, wherein the third separating mechanism is configured in such a way that the fibre strips can be guided separately free of interruption, from the inlet to the outlet of the compression channel.

16. An apparatus according to claim 11, wherein the third separating mechanism comprises at least a third separating means, the third separating means being arranged between two of the fibres strips in each case, in such a way that the latter can be guided separately free of interruption.

17. An apparatus according to claim 16, wherein the third separating means is configured as a separating web, the separating web being arranged between two of the fibre strips, in each case, in such a way that the latter can be guided separately free of interruption.

18. An apparatus according to claim 12, wherein the third separating mechanism comprises at least one third separating means, wherein the at least one first, second and third separating means is arranged between two of the fibre strips guided in parallel, in each case, in such a way that the fibre strips can be guided separately free of interruption and in parallel with the same or a different width, from the inlet region through the squeezing zone into the compression channel.

* * * * *